United States Patent [19]

Epstein

[11] 4,241,447

[45] Dec. 23, 1980

[54] SECURE SPREAD SPECTRUM COMMUNICATION SYSTEM

[75] Inventor: Marvin A. Epstein, Monsey, N.Y.

[73] Assignee: International Telephone and Telegraph Corporation, New York, N.Y.

[21] Appl. No.: 843,689

[22] Filed: Jul. 22, 1969

[51] Int. Cl.[3] ..... H04K 1/00; H04K 3/00

[52] U.S. Cl. ..... 375/1; 455/26; 371/3

[58] Field of Search ..... 375/1; 455/26, 29; 371/3

[56] References Cited

U.S. PATENT DOCUMENTS

| | | | |
|---|---|---|---|
| 3,305,636 | 2/1967 | Webb | 375/1 |
| 3,351,859 | 11/1967 | Groth, Jr. et al. | 375/1 |
| 3,432,619 | 3/1969 | Blasbalg | 375/1 |

*Primary Examiner*—Howard A. Birmiel
*Attorney, Agent, or Firm*—John T. O'Halloran; Alfred C. Hill

[57] ABSTRACT

A communication system is protected against jamming by modifying a conventional spread spectrum communication system by inserting errors, in the form of digital noise, into the pseudo-noise digital code used to generate the spread spectrum carrier. A bidirectional system is provided so that when jamming occurs, as a consequence of breaking the corrupted spread spectrum code, the pseudo-noise digital code and/or the percent of errors is changed in a prearranged manner to compensate for the jamming and/or reduce the likelihood of breaking the corrupted spread spectrum code. A conventional correlation receiver is employed to recover the intelligence.

10 Claims, 2 Drawing Figures

SECURE SPREAD SPECTRUM COMMUNICATION SYSTEM

BACKGROUND OF THE INVENTION

This invention relates to communication systems and more particularly to communication systems of the spread spectrum type.

The concept of spread spectrum as an anti-jamming technique is well known. Basically, it is desired to convey a narrow band intelligence, analog or digital in nature, occupying bandwidth w using a wideband noise-like carrier occupying bandwidth W. Both the transmitter and the receiver have copies of the noise-like carrier, but the jammer does not have a copy. The transmitter transmits the data by modulating the intelligence on the carrier using some modulation technique, such as phase shift modulation, frequency modulation, amplitude modulation, and the like. The receiver detects the intelligence by correlation detection. Because of this method of transmission, the effectiveness of a jammer will be reduced by the ratio of the spread spectrum bandwidth to intelligence bandwidth, that is, W/w. Thus, if the spread spectrum bandwidth is 100 times the intelligence bandwidth, a jammer with a given power P will have the effect of a noise-like jammer signal with P/100 applied to the intelligence signal being transmitted in a bandwidth w without spread spectrum techniques.

An essential part of this approach is that the jammer cannot reproduce the noise-like carrier and, thus, the correlation receiver rejects all but w/W of the jammer power because the noise-like carrier and the jammer's signal are independent. On the other hand, if the jammer can reproduce the noise-like carrier, it can generate a signal which consists of a narrow band modulation applied to the noise-like carrier which will be accepted by the receiver's correlator and can jam the desired signal to the same extent as if both the jamming signal and the desired signal had the same power in a narrow band w and spread spectrum were not used. In short, if the jammer can reproduce the noise-like signal, he can remove the spread spectrum advantage.

Typically, the noise-like carrier is a sine wave which is shifted in frequency at random among a set of n frequencies, of which is randomly phase shifted in steps of 0, 90, 180 or 270 degrees at some repetition rate. The frequency hopping equipment, or phase shifting equipment are driven by a digital pseudo-random (noise) code generator. Thus, the jammer's problem of generating the noise-like carrier used for transmission is largely that of generating the code. It is assumed that there is no possibility that a jammer can receive the desired signal, modify and amplify it, and retransmit it to the desired receiver so that the resultant signal is substantially accepted by the correlator. This technique is called repeat jamming and is often impractical. A typical procedure that a jammer might use to generate the code is the following. First, the generator obtains a long sequence of correct code digits. This code sequence can often be obtained from a receiver close to the transmitter. This receiver will have a strong signal and little jamming, if the jamming transmitter is far enough away. Alternatively, the jammer can silence his transmitter for some period. In many cases, the desired signal will then have a very good signal-to-noise ratio. Once a sequence of correct code digits is obtained, the jammer tries to break the code. After the code is broken, the jammer generates the noise-like carrier and the spread spectrum advantage is lost.

Present cryptographic codes and coding equipment for the United States are controlled by the National Security Agency (NSA). These codes and equipments are released for use only under stringent conditions imposed by NSA and only for specific tasks. On the other hand, the military services and agencies and even some commercial services would like to have spread spectrum capability in much of their communication equipment as a precautionary measure in case of intentional or unintentional jamming. Since the security requirements of cryptographic equipments are so much higher than those for spread spectrum systems, it has not provided feasible to supply coding equipment approved for cryptographic use with much of the spread spectrum equipment. Instead these spread spectrum equipments use some form of code generators, such as linear shift register generators, which are not approved for cryptographic use. It is well known, that once a small part of the code output of such code generators is known to the jammer he can easily break the whole code. A maximal length linear shift register generator with N stages will have a period of $2^N-1$ bits and can be broken rather easily once 2 N correct sequential bits are known. If $N=100$, the period is $2^{100}-1 \approx 10^{30}$ bits, and the code can be broken if 200 correct sequential bits of the code are given. If the spread spectrum code is broken, all the spread spectrum advantage which may be 20 to 30 db (decibel) is lost.

In summary, there is a problem in providing random code generators for spread spectrum systems. It is very expensive to provide cryptographically approved code generators with the appropriate security arrangements for all spread spectrum systems. On the other hand, the use of linear shift register codes, or similar "weak" codes for spread spectrum systems leaves these systems vulnerable to the loss of spread spectrum advantage that can result when a jammer breaks the code.

The problem with the use of the simple linear form of a linear shift register code is that the knowledge of a few correct code digits enables the breaking of the code with very little effort. Thus, there must be provided a way to complicate the form of the code to make it hard for the jammer to obtain a series of correct bits. Any attempt to complicate the code so that the code is secured, or any attempt to improve the difficulty of breaking the code immediately involves arrangements with highly classified cryptographic problems.

SUMMARY OF THE INVENTION

An object of this invention is to provide a method and arrangement for preventing a jammer from receiving a few correct bits generated, for example, by a linear shift register generator for use in a spread spectrum communication system.

Another object of the present invention is the provision of protecting linear shift register spread spectrum codes, which are easily broken by introducing random errors into the bit stream of this code without causing serious degradation of the spread spectrum system performance.

Still another object of this invention is the provision of means to protect against a jammer breaking the code used in an anti-jam spread spectrum system without resorting to code generation equipment which has a cryptographic classification.

In accordance with the principles of this invention, the introduction of errors randomly into the spread spectrum code is such that there will normally be only a small loss in spread spectrum advantage. If the coding errors are appropriately introduced at the transmitter, an unclassified pseudo-random (noise) generator, whose code can easily be broken in the clear, will receive an immunity similar to that of cryptographically certified equipment. However, since a spread spectrum system is not sensitive to even a comparatively large percentage of errors at the random code generator level, only a few db of spread spectrum advantage will be lost. In a duplex communication system the procedure need only be applied when needed and to the extent to which it is needed.

A feature of this invention is to provide secure communication apparatus comprising a first source of a given pseudo-noise digital code; first means coupled to the source to corrupt the given digital code by a predetermined percent of and distribution of errors; second means coupled to the first means to generate a spread spectrum signal in response to the corrupted given digital code; a second source of intelligence; and third means coupled to the second source and the second means to transmit the spread spectrum signal modulated by the intelligence.

Another feature of this invention is the provision of a conventional correlation receiver to recover the intelligence transmitted by the above-mentioned third means with the receiver including a fifth means to monitor the recovery of the intelligence; with the first source being adjustable to produce a plurality of different pseudo-noise digital codes in addition to the given digital code; with the first means being adjustable to produce a plurality of different percents of and distributions of errors in addition to the predetermined percent of errors; and further including a return transmission path between the receiver and the transmitter to enable the selection of a prearranged one of at least one of the plurality of digital codes and the plurality of percents of and distributions of errors when the fifth means indicates that the receiver cannot recover the intelligence with at least a given signal-to-noise ratio, or any other indication that communication is deteriorated by some given amount.

BRIEF DESCRIPTION OF THE DRAWING

The above-mentioned and other features and objects of this invention will become more apparent by reference to the following description taken in conjunction with the accompanying drawings, in which.

DESCRIPTION OF THE PREFERRED EMBODIMENT

Figure 1:
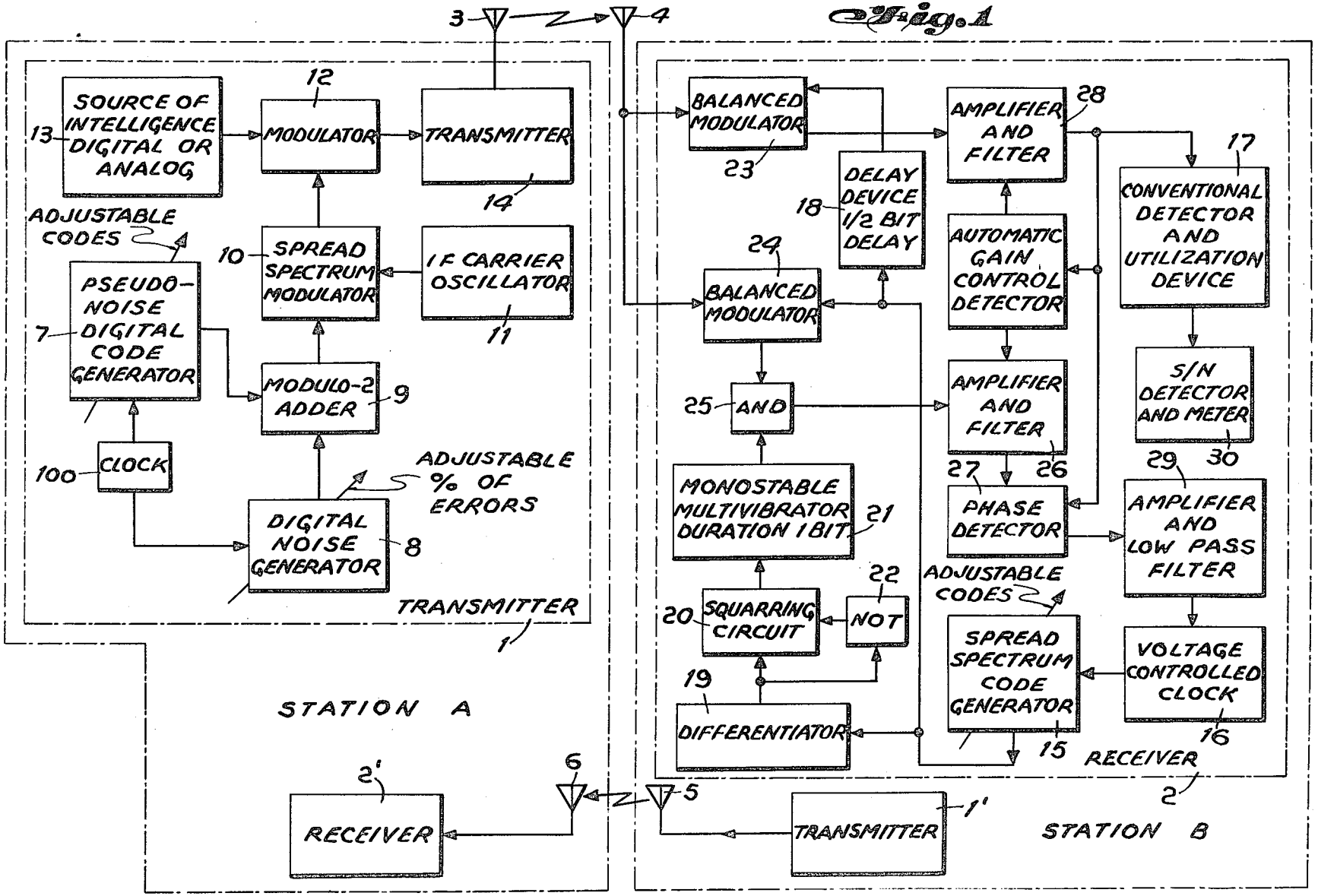
FIG. 1 is a block diagram of a secure spread spectrum communication system in accordance with the principles of this invention.

Referring to FIG. 1, there is illustrated therein a block diagram of a conventional spread spectrum communication system modified in accordance with the principles of this invention to protect against a jammer breaking the code driving the spread spectrum modulator.

As illustrated, the communication system is duplex in nature having one communication path from station A to station B through means of transmitter 1, antennas 3 and 4 and receiver 2 and a communication path from station B to station A through means of transmitter 1', antennas 5 and 6 and receiver 2'. It should be apparent that it would not be necessary to provide two separate antennas at each of the stations A and B, but rather a single antenna could be used with proper diplexing arrangements and frequency separation for the two communication paths between stations A and B.

Transmitter 1 includes a pseudo-noise digital code generator 7 which may be in the form of a linear shift register with appropriate feedback connections therein to generate the pseudo-noise code similar to the apparatus employed in conventional spread spectrum systems. In accordance with the principles of this invention, digital noise generator 8 is provided in transmitter 1 to produce random error pulses that are inserted in the code stream of generator 7 by means of modulo-2 adder 9. Adder 9 is a binary half adder or EXCLUSIVE OR gate. The timing of generators 7 and 8 are controlled by clock 100. The corrupted pseudo-noise code from the output of adder 9 is coupled to a spread spectrum modulator 10 which may be in the form of a conventional frequency hopping arrangement, or a phase shifting arrangement as employed in convention spread spectrum systems. Modulator 10 receives an IF carrier from oscillator 11. The spread spectrum carrier from modulator 10 is coupled to modulator 12 which may take the form of a phase modulator, frequency modulator, amplitude modulator or the like. Modulator 12 modulates the intelligence from source 13 which may be digital or analog in nature on the spread spectrum carrier of modulator 10 for application to transmitter 14 wherein the intelligence modulator spread spectrum IF carrier is heterodyned to the desired radio frequency carrier and provided with the desired power output for transmission from antenna 3 to antenna 4 of station B.

Receiver 2 of station B would be a conventional spread spectrum receiver compatible with the spread spectrum transmitter of station A. The receiver would include a pseudo-noise digital code generator which produces the same code as generator 7 in transmitter 1 and would employ correlation techniques to recover the intelligence modulated on the spread spectrum carrier. The receiver clock controlling the pseudo-noise digital code generator would be synchronized with the received signal by employing phase locked loop techniques to synchronize the local clock to the timing of the spread spectrum code of the received signal on antenna 4. Such an arrangement would employ either a double loop control, or a single loop control, such as disclosed in the copending application of G. Rabow and A. M. Klein, Ser. No. 764,800, filed Oct. 3, 1968 now U.S. Pat. No. 3,621,399. Another type of synchronization system that could be employed is of the early-late gate type synchronization system to assure that the local clocks is in synchronism with the received signal.

Receiver 2 of station B is illustrated in block diagram form as employing a two channel early-late gate synchronization system as described in copending application of G. Rabow, Ser. No. 762,453, filed Sept. 25, 1968, now U.S. Pat. No. 3,622,886. In this arrangement spread spectrum code generator 15 includes equipment identical to code generator 7, modulator 10 and oscillator 11 of transmitter 1 with code generator 7 driving modulator 10 directly rather than through an adder 9, since the receiver of station B does not attempt to compensate for the errors introduced in transmitter 1. The IF of code generator 15 may be a different frequency than that of oscillator 11. The output of code generator 15 is a spread spectrum carrier without the errors introduced in the code of generator 7 by generator 8 of transmitter 1. It will be assumed that the modulation of the spread spectrum carrier and the demodulation thereof in receiver 2 is accomplished by reversing carrier phase whenever the state of the code changes. The voltage controlled clock 16 couples its output to code generator 15 to produce an undelayed locally generated spread spectrum carrier which is identical to the carrier of the signal received on antenna 4 minus the noise errors. The output of generator 15 is also coupled to delay device 18 having, for instance, a half bit delay to producing a locally generated spread spectrum carrier signal. The output of generator 15 is also coupled to an arrangement to produce a gate signal whose leading edge is time coincident with the transitions of the coded signal output of generator 15. Such an arrangement may include differentiator 19 which will provide a positive spike for the positive going transitions of the undelayed code signal and negative spikes for the negative going undelayed code signal. The output from differentiator 19 is coupled to squaring circuit 20 which is constructed to operate only on positive going spike to provide a square pulse for triggering monostable multivibrator 21 which produces a gate pulse having a duration of one bit. To produce the gate signal at the negative going transitions of the undelayed code signal, some arrangement must be provided to invert the negative spike produced by differentiator 19. One way of accomplishing this is to provide NOT 22 to invert the negative spikes for operation on by circuit 20 to produce triggering pulses for multivibrator 21 at both transitions of the undelayed code signal.

The delayed code signal output of device 18 is coupled to balanced modulator 23 to remove the spread spectrum modulation on the received signal of antenna 4. The underlayed code signal from generator 15 is coupled to balanced modulator 24 and produces an output for coupling to AND 25 which is enabled by the gate signal output of multivibrator 21. The gated output of AND 25 is then amplified and filtered in amplifier and filter 26 prior to application to phase detector 27. Detector 27 has its other input coupled to modulator 23 through amplifier and filter 28 whose output is the intelligence signal without the spread spectrum modulation coupled to the remainder of the station equipment of block 17 and also provides the reference signal for phase detector 27. The output of detector 27 is coupled through amplifier and low pass filter 29 to produce a control voltage which is operable on clock 16 to provide synchronization between the delayed code signal from generator 15 and the spread spectrum modulation on the signal received on antenna 4 by providing time coincidence between these two signals. The control signal from filter 29 controls the rate or speed of clock 16 which drives generator 15 in such a way to produce a null and, hence, the desired synchronization.

The intelligence signal without spread spectrum modulation (output of amplifier and filter 28) is coupled to a conventional detector 17 which then is coupled to a utilization device.

As is obvious from the foregoing, a secure spread spectrum communication system is provided by introducing occasional random errors at the transmitter into the digital pseudo-random bit stream of the spread spectrum system by means of a true random noise generator. Thus, even if a jammer can receive the transmitted bits perfectly, there will be errors in this data. Once there are just a few errors in the received bits, a simple equation solving procedure will not enable the jammer to break the code. Rather the jammer will be forced into extensive searching through the possible error combinations and/or through the possible codes. This raises the computational effort of breaking the code by a very large factor and, thus, the combination of a linear shift register code and a true noise source of the gas tube type for introducing totally unprotectable errors produces a code with an immunity for breaking similar to that of a code approved for cryptographic use. In addition, this code need not have a high security classification, since, the components are unclassified and the disclosure of the system to the jammer does not seriously compromise the security of the code.

If the noise source at the transmitter were duplicated at the receiver there would in effect evolve a cryptographically secure code. However, a true noise source is used to introduce errors into the random bit stream at the transmitter and this noise source is not known to any one else including the receiver of the system. Thus, a gas tube, or some other device, can be added to introduce the errors, and no other change need be made in the equipment at the transmitter or the receiver. The gas tube errors cannot be selected from any amount of past history or knowledge of the apparatus.

The next question that may arise is how the receiver is affected by these errors. If there is no spread spectrum advantage, clearly each error introduced into the spread spectrum code stream will cause a receiver error. Thus, this procedure is not useful when sending encrypted data if there is neither a spread spectrum system nor error correction capability. However, if there is a large spread spectrum advantage (that is, many spread spectrum bits associated with each data bit) a few errors in the spread spectrum code stream will not be disasterous. We next analyze the case of a spread spectrum system using phase reversal modulation. Basically, if a fraction p of the spread spectrum bits are in error, the cross correlation between n bits of the transmitted signal and the corresponding receiver spread spectrum bits that have been generated without errors is $n\ (1-2p)$. This corresponds to a loss in transmitted power of a factor of $(1-2p)^2$, or $20 \log_{10} (1-2p)$db. Thus, for 15 percent errors there is about a three db loss in effective transmitter power. If a 50 bit linear shift register code were employed, 100 correct bits would be needed to break the code. When 15 percent of the bits are in error, a 100 bit block will, on the average, have 15 errors which can be distributed in about $2\times10^{17}$ ways.

Another factor to be considered is the vulnerability of a spread spectrum system when the code is broken. In ordinary cryptographic work, one can be harmed by a code being broken even if the code is no longer being used, since the data may still be of use to the jammer. In a spread spectrum system one can be harmed by a code being broken only when the code is still being used. In ordinary cryptographic work, the jammer can break a code and use the deciphered data without the transmitter or receiver being aware of any problem. In a spread spectrum system, the jammer can break a code without advising either the transmitter or the receiver of his threat, but as soon as he starts using this knowledge to jam the receiver, he reveals that the code has been broken. Thus, as will be described hereinbelow, one can use the jammer reaction, in the case of a duplex link, to change both the code and the percentage of errors just as fast as the jammer can break the code.

The following will describe how the error insertion procedure can be applied to a duplex link which is provided by transmitter 1' employing identical equipment to transmitter 1 and receiver 2' employing identical equipment as receiver 2. This procedure is that there are, at both ends of the communication links, in other words, at both stations A and B, a prearranged list of a number of code streams consisting of initial conditions and feedback connections which are not known to the jammer. When the path from station A and station B is jammed by the correct code which may be the first code on the list, the operator of station B will realize he is being jammed by observation of the meter driven by the signal-to-noise detector represented by block 30 in receiver 2. The operator then will switch his transmitter and receiver to the next code in the list which will notify the operator of station A that there is trouble and he too will switch to the next code in the prearranged list. Since the jammer may be breaking the code by receiving too many correct code digits, there will be a control in generator 8 to change the fraction of erros introduced and the spread spectrum gain in various stages. There will be a predetermined arrangement for changing these controls. Since the operators of station A and station B may not know whether the jam-to-signal ratio has increased, or whether the code has been broken and the jammer has started to use the correct code, the first step of the prearranged procedure will be an attempt to correct this situation by lowering the information rate, thus raising the spread spectrum gain. If this does not work the percentage of errors introduced will be raised until the time between outages increases to some acceptable period. Assuming that 10 codes broken per day is acceptable, the mean time between outages should be larger than 2.4 hours. If the jammer lowers his power, or the time between outages increases sufficiently, signalling procedures will be available to change the data rate and the percentage of errors introduced.

Because of the uncertainty in the time required to recognize the loss of a link some procedure is needed to prevent the forward and reverse path using different codes at any given time in such a way as to never recover communication. One method is to have both receivers 2 and 2' monitor not only present code but also all previous codes.

Figure 2:
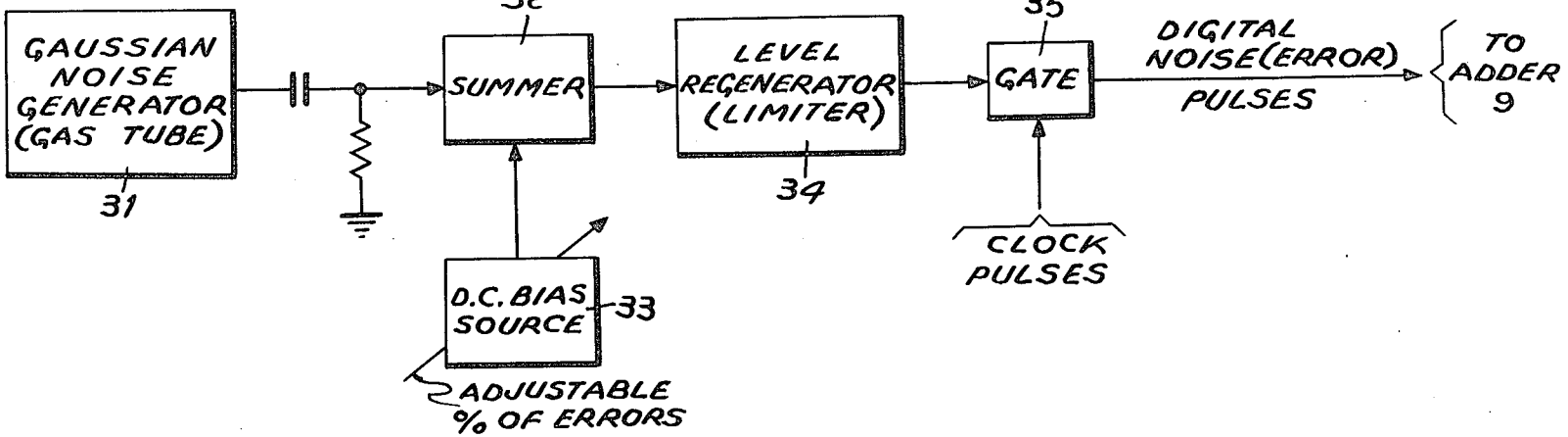
FIG. 2 is a block diagram of one embodiment of the digital noise generator of FIG. 1.

Referring to FIG. 2, there is illustrated therein one embodiment of digital noise generator 8. A Gaussian noise generator 31, such as a gas tube, is coupled to summer 32 with its other input coupled to a variable DC bias source 33. The DC bias source 33 is adjustable to control the ratio of errors to clock pulses and, thus, the percent of errors inserted into the pseudo-noise code stream. The output of summer 32 is coupled to a lever regenerator or limiter 34 whose output is sampled by the clock pulses in gate 35. Thus, the periodic sampling of the biased output of the noise source will provide an error, digital in nature, only if the corresponding sample is positive. If the bandwidth of the noise source is wide enough (that is, the sampling rate is much less than the Nyquist rate of the flat portion of the spectrum) the errors will be almost independent of each other.

Figure 3:
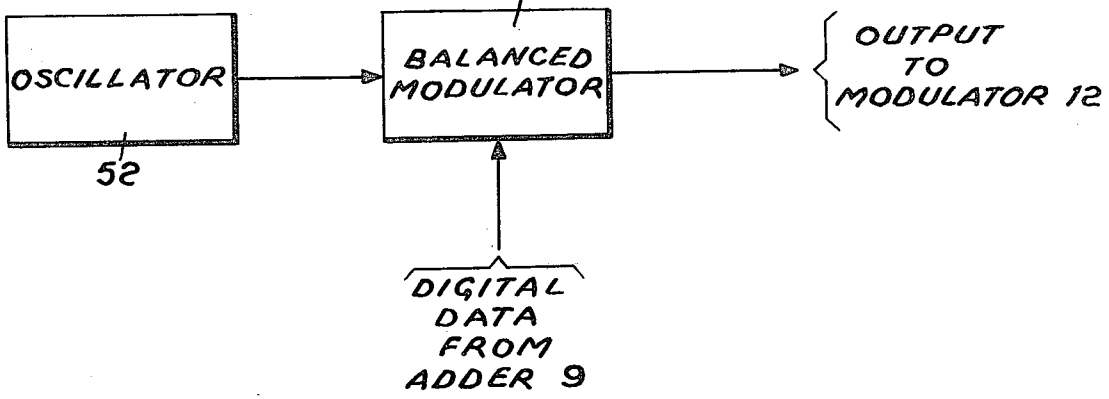
FIG. 3 is a block diagram illustrating one embodiment of the spread spectrum modulator and IF carrier oscillator, or in other words, the spread spectrum code generator of FIG. 1.

Referring to FIG. 3, there is disclosed therein a phase shift keying spread spectrum apparatus that may be employed in transmitter 1 as modulator 10 and oscillator 11 and the corresponding components in code generator 15 of receiver 2.

For instance, the output of fixed oscillator 52 is coupled to balanced modulator 53. The output of modulator 53 is in the phase or 180° out of phase with oscillator 52 depending on input from adder 9. Binary "0" corresponds to in phase condition and binary "1" corresponds to 180° out of phase condition.

While I have described above the principles of my invention in connection with specific apparatus, it is to be clearly understood that this description is made only by way of example and not as a limitation to the scope of my invention as set forth in the objects thereof and in the accompanying claims.

I claim:

1. Secure communication apparatus comprising:
a first source of a given pseudo-noise digital code;
first means coupled to said source to corrupt said given digital code by a predetermined percent of and distribution of errors;
second means coupled to said first means to generate a spread spectrum signal in response to said corrupted given digital code;
a second source of intelligence; and
third means coupled to said second source and said second means to transmit said spread spectrum signal modulated by said intelligence.

2. Apparatus according to claim 1, further including
a conventional correlation receiver coupled to said third means to recover said intelligence.

3. Apparatus according to claim 2, wherein
said receiver further includes
fourth means to monitor said recovery of said intelligence;
said first source is adjustable to produce a plurality of different pseudo-noise digital codes in addition to said given digital code;
said first means is adjustable to produce a plurality of different percents of and distributions of errors in additions to said predetermined percent of errors; and
further including
fifth means to enable the selection of a prearranged one of at least one of said plurality of digital codes and said plurality of percents of 2nd distributions of errors when said fourth means indicates that communication is lost.

4. Apparatus according to claim 1, wherein
said first means includes
a digital noise generator, and
a binary combining means coupled to said first source and said generator to corrupt said given digital code.

5. Apparatus according to claim 4, wherein
said noise generator includes
a Gaussian noise generator,
an adjustable direct current bias source,
a summing means coupled to said Gaussian noise generator and said bias source,
a level regenerator coupled to said summing means, and
a sampling means coupled to said level regenerator.

6. Apparatus according to claim 5, wherein
said Gaussian noise generator includes
a gas tube.

7. Apparatus according to claim 5, wherein
said level regenerator includes an amplitude limiter.

8. Apparatus according to claim 4, wherein said combining means includes a modulo-2 adder.

9. Apparatus according to claim 8, wherein said adder includes an EXCLUSIVE-OR gate.

10. Apparatus according to claim 4, wherein said noise generator includes a gas tube, an adjustable direct current bias source, a summing means coupled to said tube and said bias source, an amplitude limiter coupled to said summing means and a sampling means coupled to said limiter; and said adding means includes an EXCLUSIVE-OR gate.

* * * * *